United States Patent [19]

Di Manno

[11] Patent Number: 4,925,195

[45] Date of Patent: May 15, 1990

[54] THROWING DEVICE

[75] Inventor: Carl M. Di Manno, Framingham, Mass.

[73] Assignee: Throtonics Corporation, Leominster, Mass.

[21] Appl. No.: 277,356

[22] Filed: Nov. 29, 1988

[51] Int. Cl.[5] ..... A63B 65/00

[52] U.S. Cl. ..... 273/428

[58] Field of Search ..... 273/428, 424, 425, 58 J, 273/65 EE, 65 EG, 65 EC

[56] References Cited

U.S. PATENT DOCUMENTS

| | | | |
|---|---|---|---|
| 3,528,936 | 9/1970 | Kent et al. | 273/58 J X |
| 3,544,113 | 12/1970 | Hand | 273/424 |
| 3,550,940 | 12/1970 | Ball | 273/65 EE |
| 3,740,354 | 6/1973 | Dearmont | 273/58 J X |
| 3,884,466 | 5/1975 | MacDonald et al. | 273/65 EG X |
| 4,002,893 | 1/1977 | Newcomb et al. | 273/65 EE X |
| 4,133,527 | 1/1979 | Price | 273/58 J X |
| 4,339,138 | 7/1982 | Di Manno | 273/428 |

*Primary Examiner*—Paul E. Shapiro

*Attorney, Agent, or Firm*—David G. Conlin; Robert T. Gammons

[57] ABSTRACT

As herein illustrated, the device comprises a central, elongate, hollow core embodying oppositely-diverging, truncated cones integrally-connected at their smaller ends to each other, an annular gripping portion disposed about the core intermediate the opposite ends defining with the core an annular chamber about the core and a plurality of radial fins disposed in the chamber about the core connected at their opposite ends to the core and the annular gripping portion. The annular gripping portion is of generally spherical configuration and is connected at its opposite ends to the core by annular flanges. Desirably, the annular gripping portion is in the neutral area of the aero slip stream created by the ends of the leading and trailing cone ends.

7 Claims, 2 Drawing Sheets

THROWING DEVICE

BACKGROUND OF THE INVENTION

In my U.S. Pat. No. 4,339,138, there is shown a throwing device embodying a central, elongate, hollow core comprised of two truncated cones disposed small end to small end and an annular hand-gripping structure disposed about the core midway between its ends defining a hand-gripping portion of generally spherical configuration. It is the purpose of this invention to improve upon the aforesaid patented structure in such a way as to provide an improved hand-gripping portion to thus provide for better control of axial rotation without increasing drag, to provide improved shock-absorbing characteristics, to provide greater safety for the receiver, to provide a durable product which will maintain its useability after thousands of uses, to prevent collapse upon launching, to provide structural integrity, to improve tactile appeal, to provide for buoyancy, and to provide a throwing device which is easy to throw accurately over long distances and easy to catch as well.

Other advantages and improvements will be apparent to the skilled in the art from a consideration of the present disclosure and/or by practicing the claimed invention.

SUMMARY OF THE INVENTION

A throwing device comprising: an elongate hollow structure comprising two substantially frusto-concial members joined small end to small end to form a common throat; an annular gripping portion disposed about a portion of the hollow structure, and defining therewith an annular space between the hollow structure and the annular gripping portion; and radially-spaced fins disposed in said annular space about the hollow structure, the fins being connected at their ends to the hollow structure and to the annular gripping portion.

Preferably the device is made of a thermoplastic or thermoplastic rubber or foam, which has a durometer of about 30 to about 80, preferably about 40 to about 60, most preferably about 46 to 50.

Preferably the throwing device comprising a hollow structure defining a venturi, an annular jacket disposed about the venturi midway between its opposite ends and defining a hollow chamber about the venturi, and a plurality of annular supports disposed within said hollow chamber in axially-spaced, parallel relation to each other, said annular supports connected at their outer edges to said annular jacket and at their inner edges to the venturi.

The invention will now be described in greater detail with reference to the accompanying drawings, wherein:

FIG. 7 is a section of the mold assembly for molding the half sections.

Figure 2:
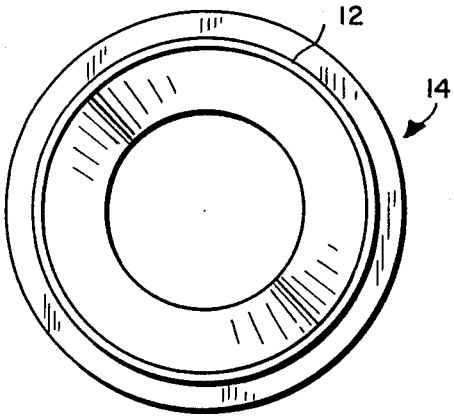
FIG. 2 is an end view of the device for one end.
Figure 1:
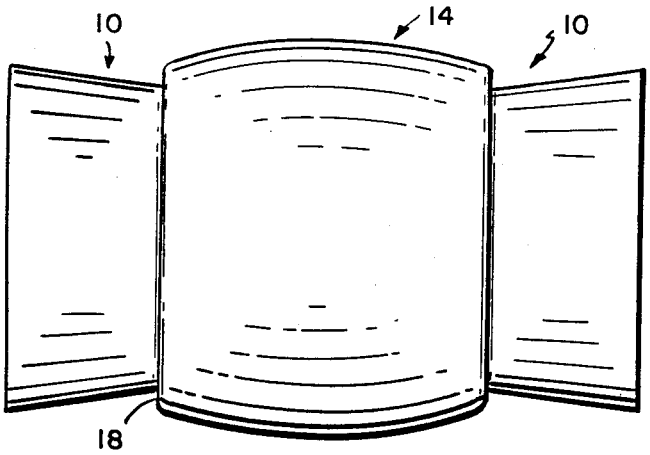
FIG. 1 is an elevation of the device.
Figure 3:
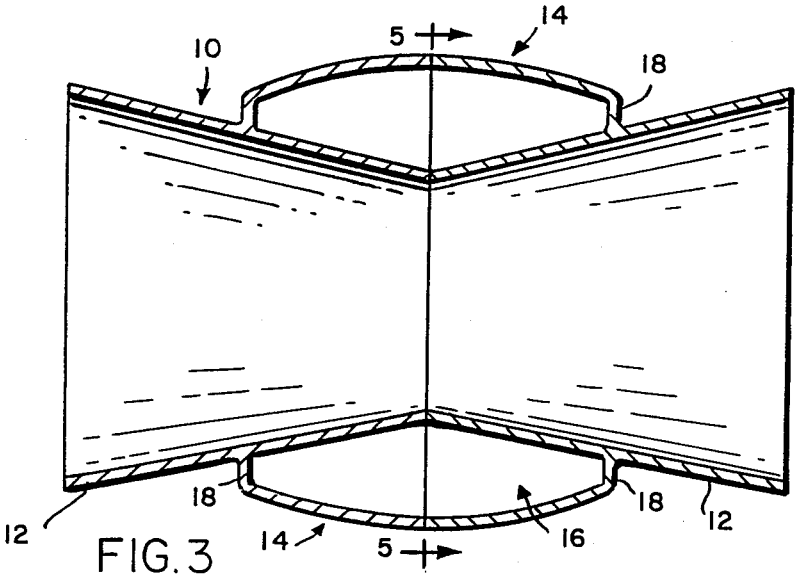
FIG. 3 is a longitudinal diametrical section taken intermediate the radial fins on the line 3-3 of FIG. 5.
Figure 5:
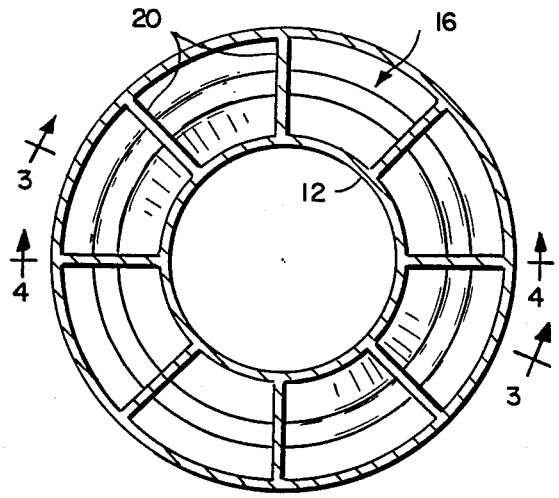
FIG. 5 is a section taken on the line 5-5 of FIG. 3.

Referring to the drawings and, specifically, to FIG. 3, which is a longitudinal section taken on the line 3—3 of FIG. 5, the device comprises an elongate, hollow structure or core 10 of circular cross section embodying a venturi structure, preferably formed by oppositely-disposed, diverging, truncated cones 12—12 which are integrally connected at their adjacent smaller ends to each other. An annular gripping portion in the form of a bladder 14 is disposed about the hollow core 10 intermediate its opposite ends and defines with the core an annular chamber 16, FIG. 3, the opposite ends of which are connected to the core by annular end walls 18, 18' formed integrally with the ends of the gripping portion 14 and with the truncated cones 12—12.

Preferably, the gripping portion is formed in a generally ellipsoidal cross section. Such a shape is believed to increase the stability of the throwing device in flight, while reducing drag and increasing ease of throwing.

Figure 4:
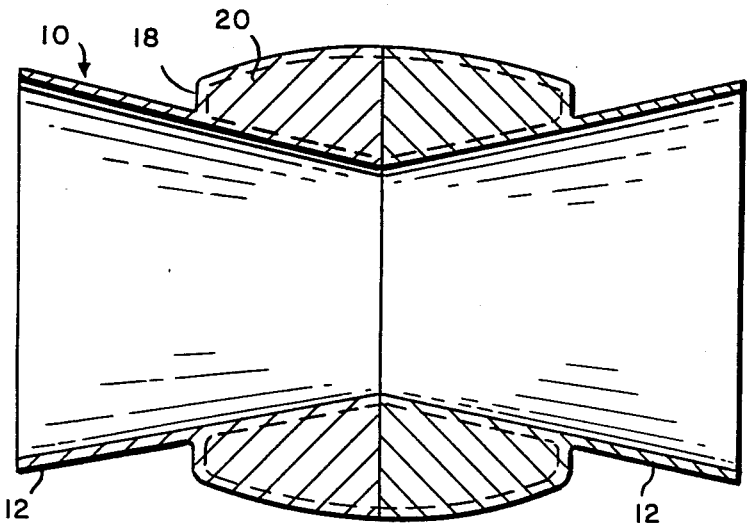
FIG. 4 is a longitudinal diametrical section taken in the plane of the radial fins on the line 4-4 of FIG. 5.

Within the annular chamber 16, FIG. 4, there are disposed radially-extending, fins 20 circumferentially spaced about the core and extending longitudinally from end-to-end of the gripping portion. Preferably there are about 6 to 10 ribs spaced around the circumference of the core. As herein illustrated, there are eight fins disposed at equal spacing about the core.

The ribs of the present invention contribute greatly to the accuracy, comfort, stability and length of throws made with the dvice, especially when the device is made of suitable materials with appropriate softness, as measured by the durometer of the material employed. When material of the appropriate durometer is employed, and the gripping portion is gripped tightly, the gripping portion deforms under the gripping pressure, so that the underlying ribs between the gripping portion and the core can be felt and used, akin to the strings on a football, to impart circular rotation to the throwing device. The ribs and the gripping portion, upon rotation of the device, tend to impart gyrostability to the device and to ease the ability of the Venturi member to quickly stabilize any wobbling or other inefficient motion of the device other than motion along its trajectory. The ribs also contribute substantial strength and durability to the device, and prevent the device from permanently deforming during the throw or the receipt of the device. At the same time, the ribbed structure of the present invention is light in weight, and easy to throw properly.

Thus the material of the appropriate durometer cooperates in use with the ribbed structure in an especially preferred way, by which the durometer is low enough to be deformed at the time of the gripping, so that the ribs can be used to spiral the throwing device, the gripping member springs back to its normal aerodynamically efficient shape during the flight of the device, and the receiver is met with a soft, yielding device which is comfortable to catch and carry. The compressibility of the gripping means can also come into play in increasing the ease of catching the device.

The devices of the present invention are preferably made by injection molding, as described further below. Suitable materials for use in the invention are soft, low durometer plastics, preferably thermoplastics or thermoplastic elastomers, such as low durometer polyvinylchloride material, thermoplastic rubber, e.g., Kraton, sold by Phillips Petroleum, foams, and other materials, which are available in the art. Presently preferred is colored or uncolored low durometer (durometer 46-50) polyvinyl chloride sold by Gary Chemical, of Leominster Mass.

The energy-absorbing truncated cones function as a venturi structure such that when the device is projected, air is forced through the passage defined by the cones causing the device to lock onto a course of least resistance, thus affording greater velocity and flight accuracy and yielding longer yardage and a natural spiral. However, the device should be sufficiently durable to withstand thousands and thousands of uses, and each use may involve velocities of 50–60 miles per hour, followed by stoppage by the recipient or other targets. Where material of too high durometer is used, it is too brittle and can easily break on 50–60 m.p.h. impacts. On the other hand, devices made of extremely soft materials having very low durometers can deform at the time of the throw, during the flight and/or on impact.

The throwing device of the present invention is surprisingly simple to manufacture by injection molding techniques, using standard injection molding equipment, but preferably with a three piece mold. Such equipment is well known and available in the art.

Figure 6:
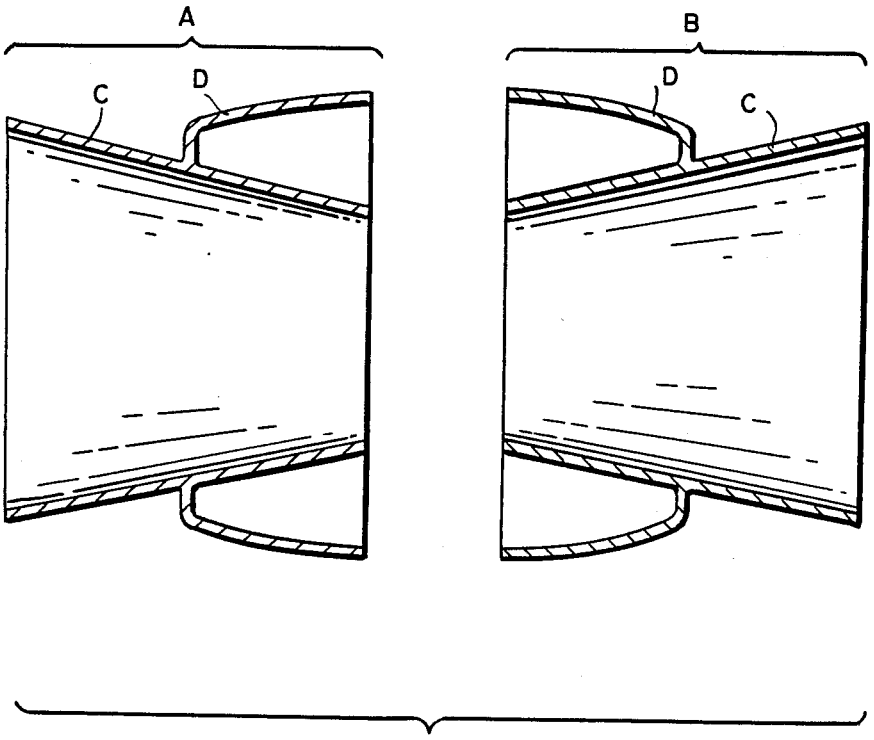
FIG. 6 is an elevation of the moldings of which the structure is comprised.

Referring to FIG. 6, the device is preferably constructed by molding two parts A and B of identical configuration comprising a truncated cone C and a hemisphere D and joining them end-to-end to each other. Molds for forming the parts are shown in FIG. 7 with the molded parts in section.

Preferably, the device is injection molded using a three piece mold, FIG. 7, with a core piece 24 corresponding to the inner portion of the gripping means D, the ribs 20 and the outer surface of the hollow structure which is enclosed under the gripping means D. Preferably, the mold cavity 26 corresponds in shape to the outside of the gripping means D and the outside of the frusto-conical members C which make up the Venturi. A further core piece 28 corresponds to the frusto-conical inner surface of one of the truncated cone members C. The injection molding machine is preferably set up so that, when the molding is done, the first and second pieces 24, 26 move away from the core 28 which formed the interior of the cone. That way, the cone has room to collapse upon itself sufficiently that the piece can be removed from the machine without tearing the device.

Typically, commercially available PVC or other pellets, having sufficient coloring or other matter to produce products of the desired color, are fed to the injection molding machine, where they are heated, typically at 340–350 degrees F., until they are melted, and they are then injected into the product molds to take on the shape of the product. After injection molding, the individual half elements are cooled to approximately room temperature, and the two halves are bonded together with the best bond possible. Preferably the halves of the device are bonded together on the molecular level, so that the entire throwing device is one complete integral body. That can be done, for example, by cooling to room temperature and treating each bonding point with a good solvent for the polymer involved. Suitable solvents for PVC include cyclohexanol, Methyl ethyl keton, and other solvents readily available in the art.

While other manufacturing methods can be used, the above-described injection molding technique is particularly advantageous in connection with the present invention. This is because the durometer and structure of the the present invention is such that the entire structure is one unitary body, which lends great strength to the structure, so much so that very low durometer polymers can be used without loss of shape or dynamics.

In the preferred form, the radially-disposed fins 20 are spaced about the core 10 approximately 1 inch apart. The inside diameter of the core midway between its opposite ends is approximately 2 inches, the diameter of the ends of the core at the outer ends is approximately 3½ inches and the axial length of the core is approximately 6½ inches. The axial length of the gripping portion 14 is approximately 3¼ inches and is of a diameter slightly larger than the diameter of the ends of the core. The gripping portion 14 which circumscribes the truncated cones 12—12 entraps air to thus provide a subtle grip, absorbs energy for comfortable catching, creates stability and balance and enhances the grip by providing an internal platform that functions much like the laces on a football. The configuration is specifically designed to conform to the human hand regardless of age.

The device is comprised of a high tech resin which is highly flexible, extremely durable, safe and non-toxic, easy to grip, easy to catch and providing an ideal throwing weight.

Though some specific embodiments of the present invention have been described, various modificaitons and variations can be made by those skilled in the art. It should be understood that such modifications are encompassed within the scope of this invention as indicated by the following claims.

What is claimed is:

1. A throwing device comprising an elongate, hollow structure comprising two substantially frustoconical members joined small end to small end to form a throat, an annular gripping portion disposed about a portion of the hollow structure and defining therewith an annular space between the hollow structure and the annular gripping portion, and radially-spaced fins disposed in said annular space throughout the hollow structure, said fins being connected at their ends to the hollow structure and to the annular gripping portion and wherein the fins divide the annular space between the portion of the hollow structure adjacent the juncture and the annular gripping portion into closed cells.

2. A throwing device according to claim 1 wherein there are 8 radially-disposed fins.

3. A throwing device according to claim 1 wherein said radially-disposed fins are spaced about the core approximately one inch between fins.

4. A throwing device according to claim 1 wherein the inside diameter of the core midway between its opposite ends is in the order of 2 inches.

5. A throwing device according to claim 1 wherein the diameter of the ends of the core is in the order of 3½ inches.

6. A throwing device according to claim 1 wherein the axial length of the core is approximately 6½ inches.

7. A throwing device according to claim 1 wherein the axial length of the annular gripping portion is approximately 3¼ inches.

* * * * *